US007658028B2

(12) United States Patent
Pintar et al.

(10) Patent No.: US 7,658,028 B2
(45) Date of Patent: Feb. 9, 2010

(54) FIREARM SECURITY DEVICE

(76) Inventors: Kevin B. Pintar, 2094 S. Scranton, Boise, ID (US) 83709; Robert W. Corrigan, 3691 Bonnie La., Boise, ID (US) 83703

( * ) Notice: Subject to any disclaimer, the term of this patent is extended or adjusted under 35 U.S.C. 154(b) by 0 days.

(21) Appl. No.: 12/022,534

(22) Filed: Jan. 30, 2008

(65) Prior Publication Data

US 2008/0178509 A1 Jul. 31, 2008

Related U.S. Application Data

(60) Provisional application No. 60/887,393, filed on Jan. 31, 2007.

(51) Int. Cl.
*F41C 21/00* (2006.01)

(52) U.S. Cl. ..... 42/70.07; 42/70.06; 42/70.11

(58) Field of Classification Search ..... 42/70.06, 42/70.07, 70.11

See application file for complete search history.

(56) References Cited

U.S. PATENT DOCUMENTS

| | | | | |
|---|---|---|---|---|
| 321,930 | A | | 7/1885 | Wunderlick |
| 795,566 | A | | 7/1905 | Wallace |
| 2,593,402 | A | | 4/1952 | Aitchison et al. |
| 2,752,046 | A | | 6/1956 | Levy |
| 2,998,885 | A | | 9/1961 | Surface |
| 3,007,581 | A | | 11/1961 | Moore |
| 3,876,078 | A | | 4/1975 | Gomes et al. |
| 4,113,107 | A | | 9/1978 | Jaeger |
| 4,182,453 | A | | 1/1980 | Worswick |
| 4,461,385 | A | | 7/1984 | Clouser |
| 4,579,263 | A | | 4/1986 | Ehmke et al. |
| 4,696,405 | A | | 9/1987 | Waring |
| 4,986,427 | A | | 1/1991 | Law et al. |
| 5,022,536 | A | | 6/1991 | Pierson |
| 5,138,786 | A | | 8/1992 | Fischer |
| 5,263,592 | A | | 11/1993 | Dingee, Jr. |
| 5,350,094 | A | | 9/1994 | Morford |
| 5,443,191 | A | | 8/1995 | Jorgenson |
| 5,454,931 | A | | 10/1995 | Lauve |
| 5,561,935 | A | * | 10/1996 | McCarthy et al. ..... 42/70.07 |
| 5,621,996 | A | * | 4/1997 | Mowl, Jr. ..... 42/70.07 |
| 5,768,819 | A | | 6/1998 | Neal ..... 42/96 |
| 5,791,499 | A | | 8/1998 | Zebbedies |
| 5,797,500 | A | | 8/1998 | Lacoste |
| 5,899,102 | A | * | 5/1999 | Ling ..... 70/312 |
| 5,918,402 | A | * | 7/1999 | Weinraub ..... 42/70.07 |
| 6,047,870 | A | | 4/2000 | Morford |

(Continued)

*Primary Examiner*—Troy Chambers
*Assistant Examiner*—Samir Abdosh
(74) *Attorney, Agent, or Firm*—Holland Law Office PLLC

(57) ABSTRACT

A firearm security device including a frame to which a fixed plate and a movable plate are attached. A grip pad is attached to each of the opposing inner sides of the fixed and movable plates. A trigger guard stud is attached to and projects from the inner face of the fixed plate. The trigger guard stud inserts through the trigger guard of the firearm. Means are provided for shifting the movable plate from an open position wherein the firearm is positioned with the trigger guard stud projecting through the trigger guard, to a closed position where the movable plate is positioned substantially parallel to the fixed plate and at least a portion of the receiver of the firearm is held in a compressive grip between the grip pads. A lock selectively restricts operation of the shifting means and the movable plate.

2 Claims, 7 Drawing Sheets

U.S. PATENT DOCUMENTS

| | | | | |
|---|---|---|---|---|
| 6,206,261 | B1 | 3/2001 | McCrary | |
| 6,360,931 | B1 | 3/2002 | Morford | |
| 6,364,339 | B1 | 4/2002 | Lee | |
| 6,543,260 | B2 | 4/2003 | Koy et al. | |
| 6,584,719 | B1 | 7/2003 | Morford | |
| 6,585,209 | B1 | 7/2003 | Mattingly | |
| 6,601,332 | B1 * | 8/2003 | Riebling | 42/70.11 |
| 7,047,771 | B2 | 5/2006 | Tanos | 70/16 |
| 7,367,150 | B2 * | 5/2008 | Farchione et al. | 42/70.07 |
| 2002/0069569 | A1 * | 6/2002 | Riebling et al. | 42/70.07 |
| 2002/0133998 | A1 * | 9/2002 | Murray et al. | 42/70.07 |
| 2004/0216349 | A1 * | 11/2004 | Riebling et al. | 42/70.07 |

* cited by examiner

FIREARM SECURITY DEVICE

RELATED APPLICATIONS

This application claims the priority of Provisional Application Ser. No. 60/887,393 entitled Firearm Security Device, filed Jan. 31, 2007, the content of said application being incorporated herein by reference.

BACKGROUND OF THE INVENTION

1. Field of the Invention

This invention relates to firearm security devices, and more particularly to a firearm security device for holding a firearm in a secure manner.

2. Background

The prior art includes a variety of gun racks configured for displaying, holding or securing a variety of firearms. Additionally, the prior art includes a variety of firearm locking assemblies including several that lock through the trigger guard as demonstrated by the lock and chain arrangement shown in U.S. Pat. No. 4,461,385 to Clouser, and the cable and lock arrangement shown in U.S. Pat. No. 5,263,592 issued to Dingee, Jr.

Additionally many firearms are configured to permit a rapid knockdown of various components including the upper receiver, ammo clips, barrel sections and stock members. Many of the firearm securing devices of the prior art, while capable of securing a firearm in toto, do not prevent against the removal of component parts that are designed for rapid knockdown.

It would be desirable to provide a firearm security device that is configured to secure a firearm in a manner that allows a secure placement or location of the firearm and which also provides the option of allowing the firearm to be locked in the firearm security device thereby increasing firearm security. Additionally, it may be desirable to provide a firearm security device that is specifically adapted to various tactical weapons utilized by the military and law enforcement personnel.

One object of the present invention is to provide a firearm security device that is adaptable to secure a wide variety of firearms, including pistols, rifles, including tactical rifles and shotguns. Another objective of the present invention is to provide a firearm security device that may be configured or adapted to prevent removal of component parts of the firearm while the firearm is secured in the device. Another objective of the present invention is to provide a firearm security device that may be adapted to various tactical weapons utilized by the military and law enforcement personnel.

SUMMARY OF THE INVENTION

The present invention is directed to a firearm security device that includes a fixed plate attached to a frame member and a movable plate also attached to a frame member. A grip pad is attached to and covers an inner surface of the fixed plate. Similarly, a grip pad is attached to and covers an inner surface of the movable plate. A trigger guard stud is attached to the fixed plate projecting from the inner face of the fixed plate. The trigger guard stud is adapted for insertion through the trigger guard of the firearm. Preferably, the trigger guard stud includes a case hardened steel post that is surrounded by a pad. The movable plate is movable in the sense that it may be shifted from an opened position where a firearm may be placed into or removed from the device, to a closed position wherein at least a portion of the receiver of the firearm is held in a compressive grip between the grip pads.

A plate shifting assembly may be attached to the frame and the movable plate and is adapted to reposition the movable plate from an open position wherein the firearm may be positioned with the trigger guard stud projecting through the trigger guard of the firearm, to a closed position wherein the movable plate is positioned in a closed position substantially parallel to and opposing the fixed plate. In the preferred embodiment of the invention, the plate shifting assembly is configured as a clamping assembly having an over-center clamping action. Other linkages, mechanisms and means may perform the function of the plate shifting assembly, for instance a four-bar linkage may be adapted to the device to shift the movable plate from the opened to the closed position. Similarly, any number of mechanical, electrical, hydraulic or pneumatic devices and assemblies may be adapted to the function.

The preferred embodiment of the firearm security device also includes a firearm support member connected to the fixed plate and adapted to support the firearm below the receiver. In one embodiment, the firearm support member is configured as a receiver support pad that is attached to the fixed plate projecting from the inner face of the fixed plate. Preferably, the receiver support pad includes a rigid post that secures the pad to the fixed plate. The receiver support stud is adapted for positioning to the rear of the receiver of the firearm.

Alternately, the firearm support member may be configured as a rifle/shotgun adapter that is adapted to grasp an upper and a lower surface of the grip portion of a rifle or shotgun stock.

In the preferred embodiment, the firearm security device includes a base assembly to which a frame member is pivotably attached. The base assembly provides means for attaching the firearm security device to a surface. The pivotability of the base assembly permits the adjustment of the angle of the frame to the base to permit customization of installation.

In the preferred embodiment of the invention, the grip pads, the pads of the trigger guard stud and the receiver support stud and the rifle/shotgun adapter are all formed of a vibration resistant polymeric material that will not react to the materials, surfaces and finished employed in firearm manufacture. The grip pads may be configured to accommodate various surface features and mechanisms located on or projecting from the side of the receiver portion of the firearm that the grip pad is to be positioned against.

The preferred embodiment of the firearm security device also includes a locking mechanism that is adapted to selectively restrict movement of the movable plate relative to the opposing fixed plate. Thus when the firearm security device is locked neither the firearm itself nor parts that are designed for rapid knock-down, disassembly or removal may be accessed for such rapid knock-down, disassembly or removal. Depending on the needs of a particular owner, the lock may be configured as a simple keyed or combination padlock, as a cylinder lock having an axially actuated bolt, or as an electrically operated or electronically or magnetically controlled device.

In the preferred embodiment a distance between the fixed plate and the movable plate in a closed position, with both the fixed plate and the movable plate positioned substantially parallel to one another, is adjustable to accommodate firearms having receivers of various widths.

DETAILED DESCRIPTION

Figure 3:
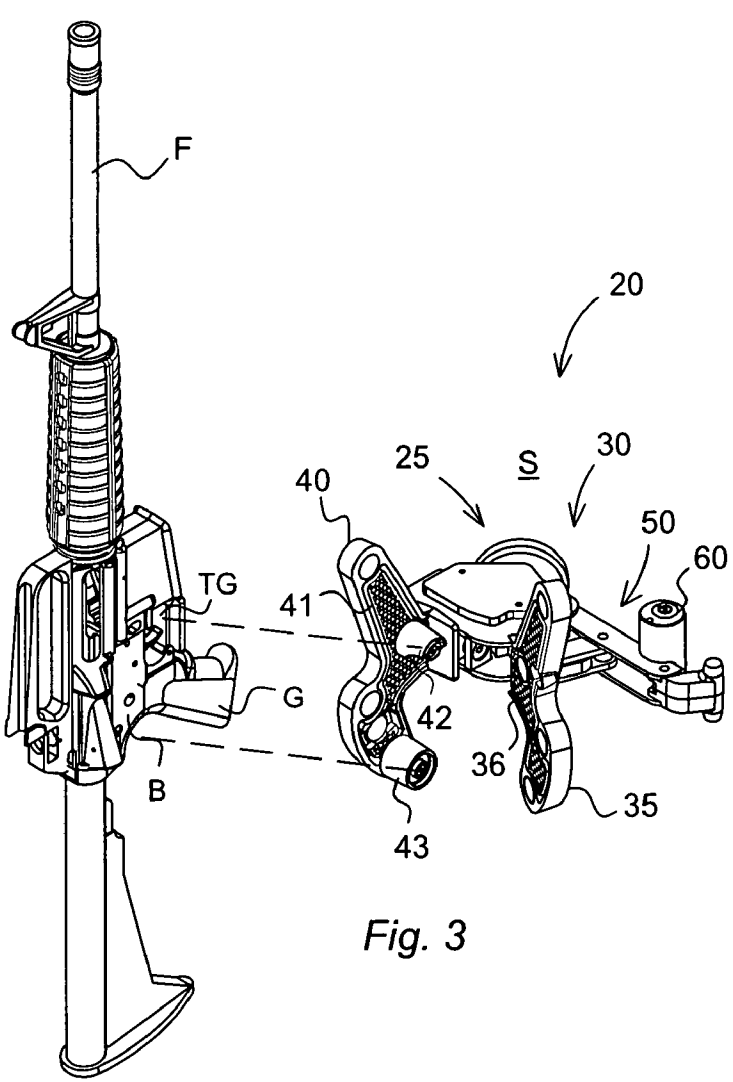
FIG. 3 is a representative perspective view of a firearm security device according to a preferred embodiment of the present invention.
Figure 2:
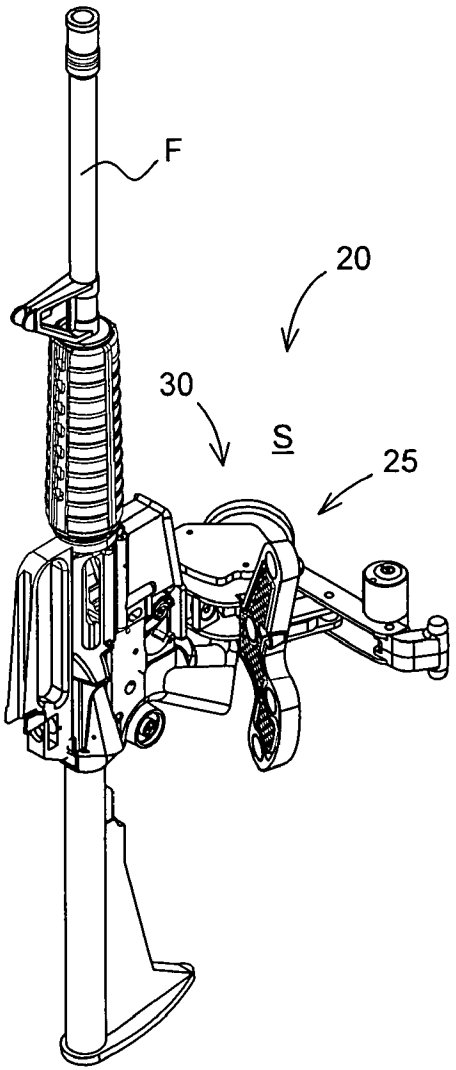
FIG. 2 is a representative perspective view of a firearm security device according to a preferred embodiment of the present invention.
Figure 1:
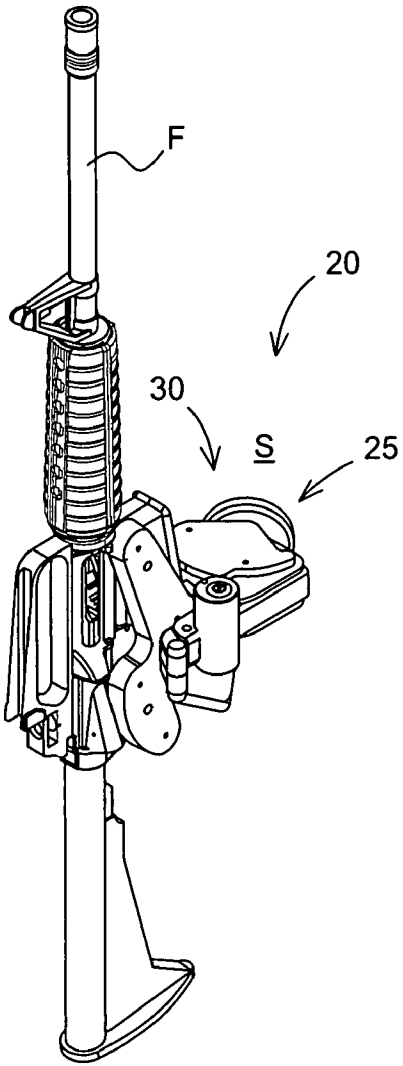
FIG. 1 is a representative perspective view of a firearm security device according to a preferred embodiment of the present invention.

Referring to FIGS. 1 through 3 firearm security device 20 will be described in further detail. As shown in FIGS. 1 through 3, firearm security device 20 includes frame assembly 30. Frame assembly 30 is pivotably connected to base assembly 25. Base assembly 25 of firearm security device 20 mounts to a surface S. A firearm, in this case assault rifle R is shown secured in firearm security device 20.

FIG. 3 shows movable plate 35 shifted away from fixed plate 40 by operation of clamping assembly 50, which in the preferred embodiment provides the plate shifting assembly. Firearm F is shown removed from firearm security device 20. As shown in FIG. 3, fixed plate 40 includes first grip pad 41 attached to an inward facing surface of fixed plate 40. Similarly, movable plate 35 includes second grip pad 36 attached to an inward facing surface of movable plate 35, second grip pad 36 having a generally opposing orientation to first grip pad 41. Trigger guard pad 42 and grip support pad 43 are attached to fixed plate 40 and project from an inner surface of first grip pad 41.

To secure firearm F with firearm security device 20, and with continuing reference to FIG. 3, firearm F is positioned such that trigger guard pad 42 is inserted through trigger guard TG and grip G is positioned so that a rear portion of receiver B rests on top of grip support pad 43. Movable plate 35 is pivotably shifted towards fixed plate 40 by operation of clamping assembly 50 and firearm F is thereby secured in firearm security device 20. In the preferred embodiment, clamping assembly 50 is designed having an over-center clamping action such that when the linkage is advanced to an over-center position, clamping assembly 50 remains in a positive locked position, exerting a compressive gripping force between movable plate 35 and fixed plate 40.

In the preferred embodiment, fixed plate 40 including its attached first grip pad 41 and movable plate 35 including its attached second grip pad 36 are configured such that any and all firearm knock-down mechanisms including pins, pulls, latches and releases for barrels, stocks and magazines or the like are covered when firearm F, in this case an assault rifle is secured in firearm security device 20. It should also be noted that the device shown in FIGS. 1-3 is also adapted to secure many pistols that include a trigger guard through which trigger guard pad 42 would be insertable. Similarly it should also be noted that movable plate 35 and fixed plate 40 as well as second grip pad 36 and first grip pad 41 may all be customized for a particular firearm or need and still be considered within the scope of the present invention.

Firearm security device 20 is adapted to selectively lock the fixed and movable plate 35 and fixed plate 40 in the closed position employing, in the case of the preferred embodiment, tubular lock 60 that includes an axially actuated bolt.

Figure 5:
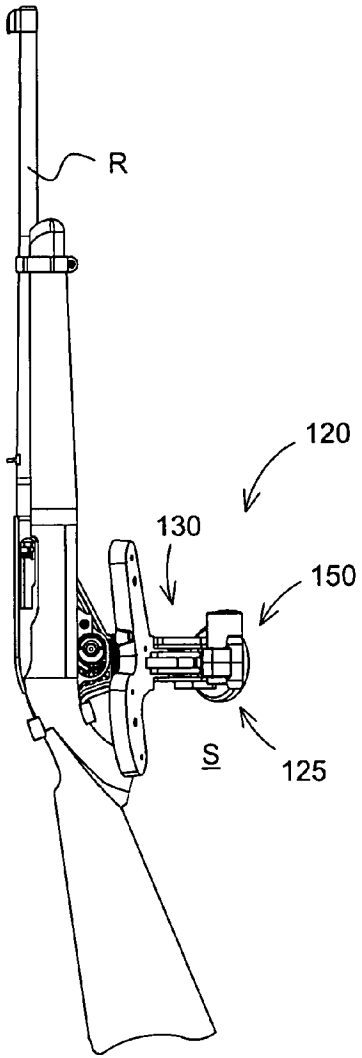
FIG. 5 is a representative side view of a firearm security device according to one preferred embodiment of the present invention.
Figure 4:
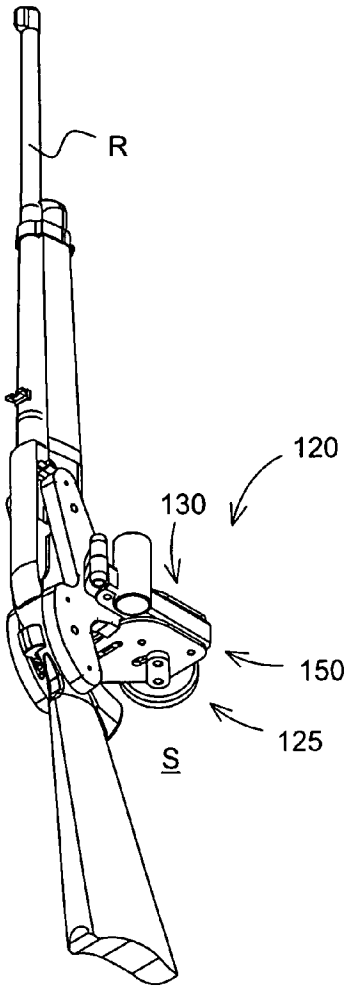
FIG. 4 is a representative perspective view of a firearm security device according to one preferred embodiment of the present invention.

FIGS. 4 and 5 show firearm R in this case a shotgun having a receiver B and a rifle type stock RS with grip portion G, held by firearm security device 120. As shown in FIGS. 3 through 6, firearm security device 120 includes frame assembly 130. Frame assembly 130 is pivotably connected to base assembly 125. Base assembly 125 of firearm security device 120 mounts to a surface S.

Figure 6:
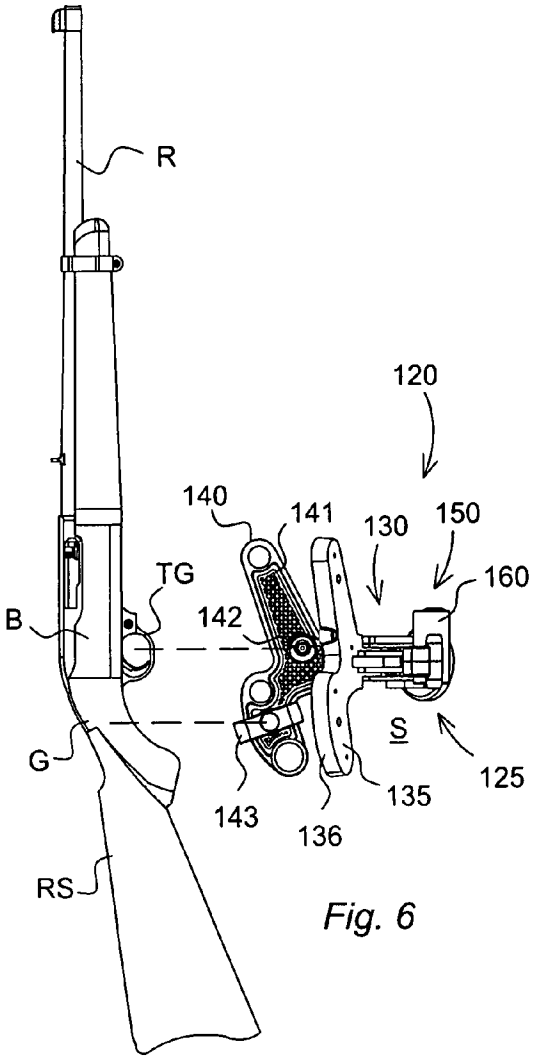
FIG. 6 is representative side view of firearm security device according to one preferred embodiment of the present invention.

FIG. 6 shows movable plate 135 shifted away from fixed plate 140 by operation of clamping assembly 150, which in the preferred embodiment provides the plate shifting assembly. Firearm R is shown removed from firearm security device 120. Movable plate 135 is may be pivotably shifted towards fixed plate 140 by operation of clamping assembly 150 which includes an over-center clamping action clamping assembly 150 remains in a positive locked position in the absence of continued pressure, exerting a compressive gripping force between movable plate 135 and fixed plate 140.

As shown in FIG. 6, fixed plate 140 includes first grip pad 141 attached to an inward facing surface of fixed plate 140. Similarly, movable plate 135 includes second grip pad 136 attached to an inward facing surface of movable plate 135. Second grip pad 136 has a generally opposing orientation to first grip pad 141. Trigger guard stud 142 and rifle/shotgun adapter 143 are attached to fixed plate 140 and project from an inner surface of first grip pad 141.

As shown in FIG. 6, trigger guard stud 142 is adapted to project through trigger guard TG of firearm R and while rifle/shotgun adapter 143 is adapted to grasp firearm R about grip portion G of the stock RS. Firearm security device 120 is adapted to permit locking movable plate 135 and fixed plate 140 in the closed position employing, in the case of the preferred embodiment, tubular lock 160 that includes an axially actuated bolt.

Second grip pad 136, first grip pad 141, trigger guard stud 142, rifle/shotgun adapter 143, and referring to FIG. 3, second grip pad 36, first grip pad 41, trigger guard pad 42 and grip support pad 43 are all preferably formed of a polymeric material exhibiting good vibration isolation characteristics and design. Also in the preferred embodiment, the second grip pad 36, first grip pad 41, trigger guard pad 42 and grip support pad 43 are each formed of a no-marring material that does not react with metal and metal finishes commonly used on firearm parts or wood and finishes used on wood parts for firearms.

Figure 8:
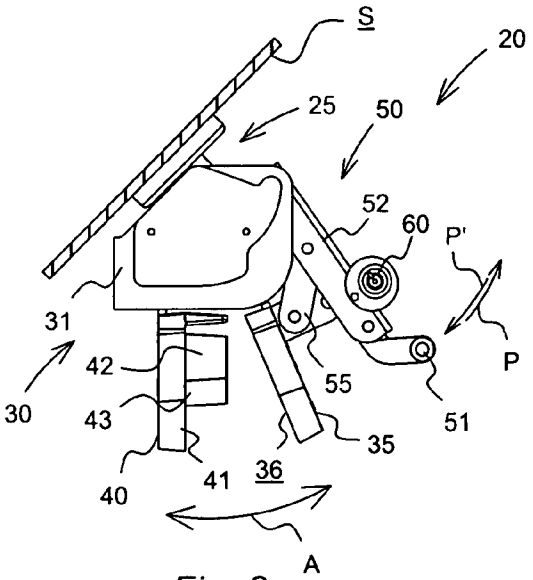
FIG. 8 is a representative top view of a firearm security device according to one preferred embodiment of the present invention.
Figure 9:
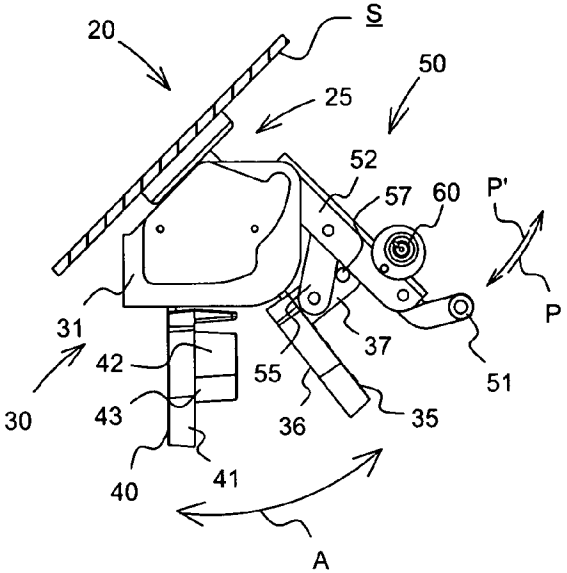
FIG. 9 is a representative top view of a firearm security device according to one preferred embodiment of the present invention.
Figure 7:
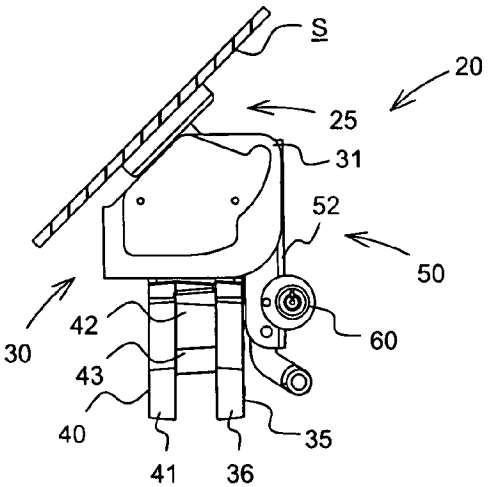
FIG. 7 is a representative top view of a firearm security device according to one preferred embodiment of the present invention.
Figure 11:
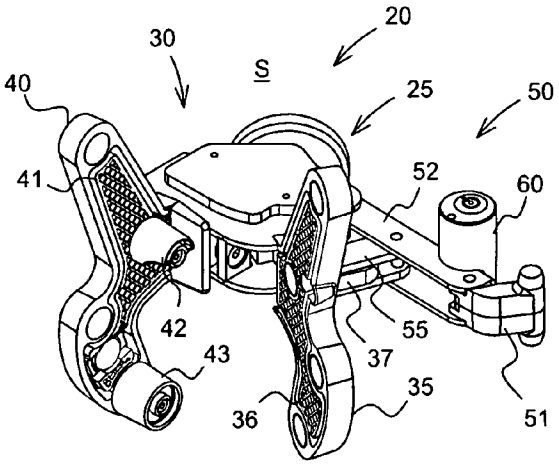
FIG. 11 is a representative perspective view of a firearm security device according to one preferred embodiment of the present invention.
Figure 12:
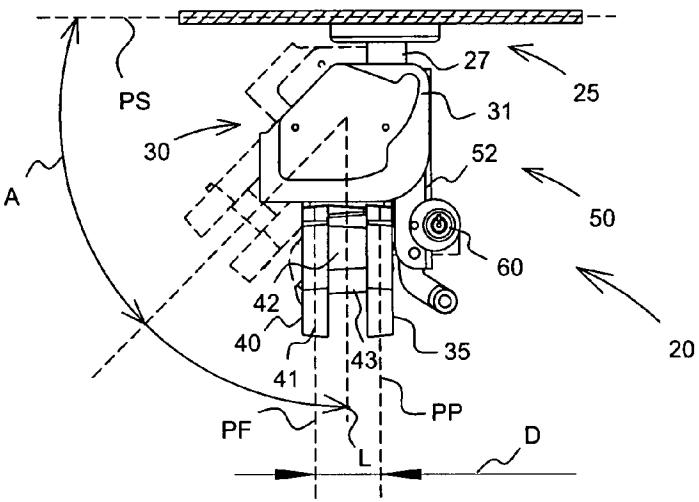
FIG. 12 is a representative top view of a firearm security device according to one preferred embodiment of the present invention.
Figure 10:
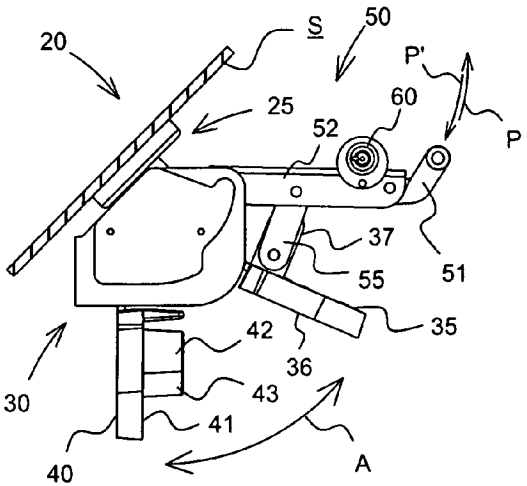
FIG. 10 is a representative top view of a firearm security device according to one preferred embodiment of the present invention.

FIGS. 7 through 12 are a series of views showing firearm security device 20 to advantage. Firearm security device 20 includes frame assembly 30. Frame assembly 30 includes frame member 31 which is pivotably connected to base assembly 25. Base assembly 25 of firearm security device 20 mounts to a surface S. Second grip pad 36 is shown attached to movable plate 35. Trigger guard stud 42 and grip support pad 43 are attached to fixed plate 40 and project from an inner surface of first grip pad 41. Movable plate 35 is shifted from a closed position as seen in FIG. 7 to an open position, as seen in FIGS. 10 and 12, by operation of clamping assembly 50. In the preferred embodiment, tubular lock 60 is attached to lever 52.

FIG. 7 shows movable plate 35 in a substantially parallel position relative to fixed plate 40. In this position, a firearm, (not shown in FIG. 7), may be secured between movable plate 35 and fixed plate 40.

FIGS. 8 and 9 show firearm security device 20 with movable plate 35 shifted to an increasingly opened position. A pulling force, indicated by the vector P is applied to pull 51 causing movable plate 35 to articulate along arc A. Linkage 55 can be seen connecting lever 52 to movable plate 35. More particularly, as shown in FIG. 9, linkage 55 extends between lever 52 and tab 37 which is attached to and extends from movable plate 35. As pulling force P is applied to pull 51 of lever 52 and a force is transmitted to movable plate 35 through linkage 55 and tab 37. Aperture 57 located at a distal end of tab 37 can be seen in FIG. 9. In the fully closed position shown in FIG. 7, tab 37 extends through a slot, (not shown), in lever 52 and aperture 57 aligns with a bolt, (not shown), of lock 60.

FIGS. 10 and 11 show firearm security device 20 with movable plate 35 shifted to a fully opened position. In the fully opened position, a firearm, (not shown in FIG. 10), may be positioned or removed from between movable plate 35 and fixed plate 40. To secure a firearm, between movable plate 35 and fixed plate 40, a pushing force, indicated by the vector P', shown in FIGS. 8-10, is applied to pull 51 causing movable plate 35 to articulate along an arc indicated by the arc A, shown in FIGS. 8-10, to a closed position as seen in FIG. 7.

FIG. 12 is a top elevational view of firearm security device 20 that shows the adjustable relationship between frame member 31 and spindle 27 of base assembly 25. This feature of the device allows a user to adjust an angle A between a line L parallel to the faces of movable plate 35 and fixed plate 40 and a primary plane PS of surface S. FIG. 12 also shows the substantially parallel and opposing orientation of movable plate 35 and fixed plate 40 as shown by line PF that lies parallel to a primary plane of fixed plate 40 and line PP that lies parallel to a primary plane of movable plate 35. Distance D between movable plate 35 and fixed plate 40 can be varied to accommodate firearms having receivers of a variety of widths.

Figure 13:
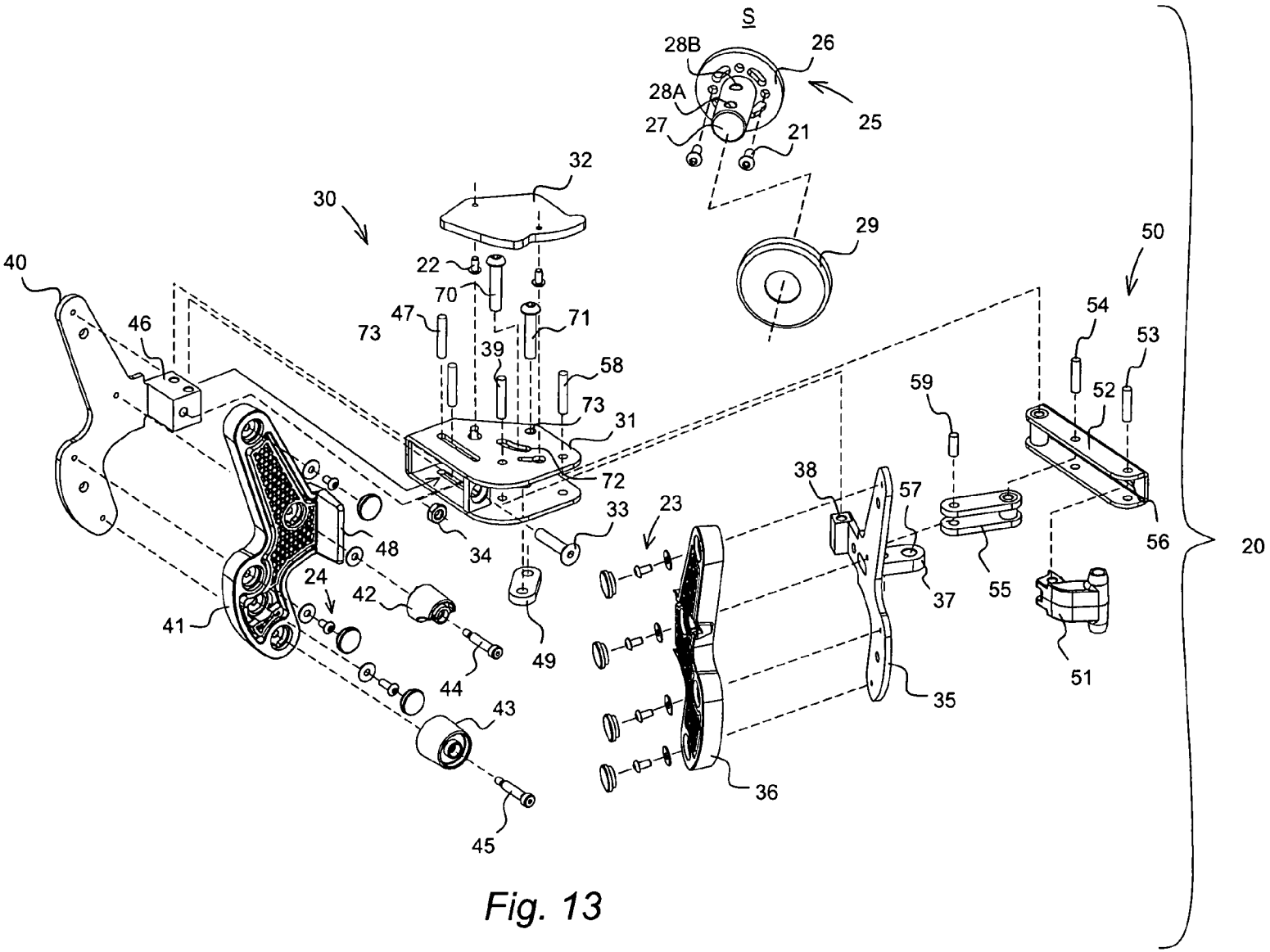
FIG. 13 is a representative exploded view of a firearm security device according to one preferred embodiment of the present invention.

FIG. 13 is an exploded view of firearm security device 20. Firearm security device 20 includes movable plate 35 and fixed plate 40 connected to frame member 31 of frame assembly 30. Second grip pad 36 is attached to movable plate 35 by a plurality of screw and plug assemblies of which screw and plug assembly 23 is typical. Similarly, first grip pad 41 is attached to fixed plate 40 by a plurality of screw and plug assemblies of which screw and plug assembly 24 is typical. Trigger guard stud 42 attaches to fixed plate 40 with screw 44. Similarly, grip support pad 43 attaches to fixed plate 40 with screw 45. In the preferred embodiment, screws 44 and 45 are hardened steel screws. Bumper 48 extends from the face of first grip pad 41 and protects the trigger guard of a firearm from contact with frame member 31.

Frame assembly 30 is pivotably connected to base assembly 25. Spindle 27 extends from base portion 26 which is in turn attached to surface S. Base security cover 29 is placed over spindle 27 covering base portion 26 and screws 21. It should be noted that surface S may include any of a variety of surfaces including flat or curving surfaces, extruded or otherwise formed tracks, channels and modular systems to which base portion 26 and screws 21 may be adapted to secure firearm security device 20 to such surface.

A pair of screws 70 and 71, project through slotted aperture 72 and pivot aperture 73 of frame member 31 and a pair of apertures 28A and 28B of spindle 27, connecting to backing strip 49. Frame security cover plate 32 attaches to frame member 31 with screws 22 covering and securing screws 70 and 71 from removal.

Fixed plate 40 is attached to slide block 46 which in turn is slideably mounted to frame member 31. A pair of pins typified by pin 47 insert through frame member 31 and slide block 46. Adjustment screw 33 threadedly engages slide block 46. In moving adjustment screw 33 in or out, the location of fixed plate with respect to frame member 31 is adjusted and thereby the distance between fixed plate 40 and movable plate 35 may be varied to accommodate the receivers of various firearms having different widths. Once fixed plate 40 is adjusted laterally with respect to frame member 31, lock nut 34 is tightened to maintain the desired position.

Movable plate 35 is attached to block 38 which, in turn is mounted to frame member 31. Pin 39 inserts through frame member 31 and block 38 permitting pivotal movement of movable plate 35 about pin 39.

Movable plate 35 is shifted with respect to fixed plate 40 by operation of clamping assembly 50. Clamping assembly 50 includes pull 51 located at the end of lever 52. In the described embodiment, pull 51 is attached at the end of lever 52 with pin 53. Lever 52 is pivotably attached to frame member 31 by pin 58. Lever 52 is also pivotably attached to movable plate 35 via linkage 55. More particularly linkage 55 is pivotably attached to lever 52 by pin 54 and to tab 37 which is attached to and extends from movable plate 35, by pin 59. Aperture 57 located at a distal end of tab 37 is adapted to project slot 56 located in lever 52 and is engageable with a lock to control access to a stored firearm. It should be noted that any of a variety of locks may be employed with the present invention including keyed and combination padlocks, electrically, electronically or magnetically controlled locks and locks of a variety of configurations depending the requirements of the user.

Figure 14:
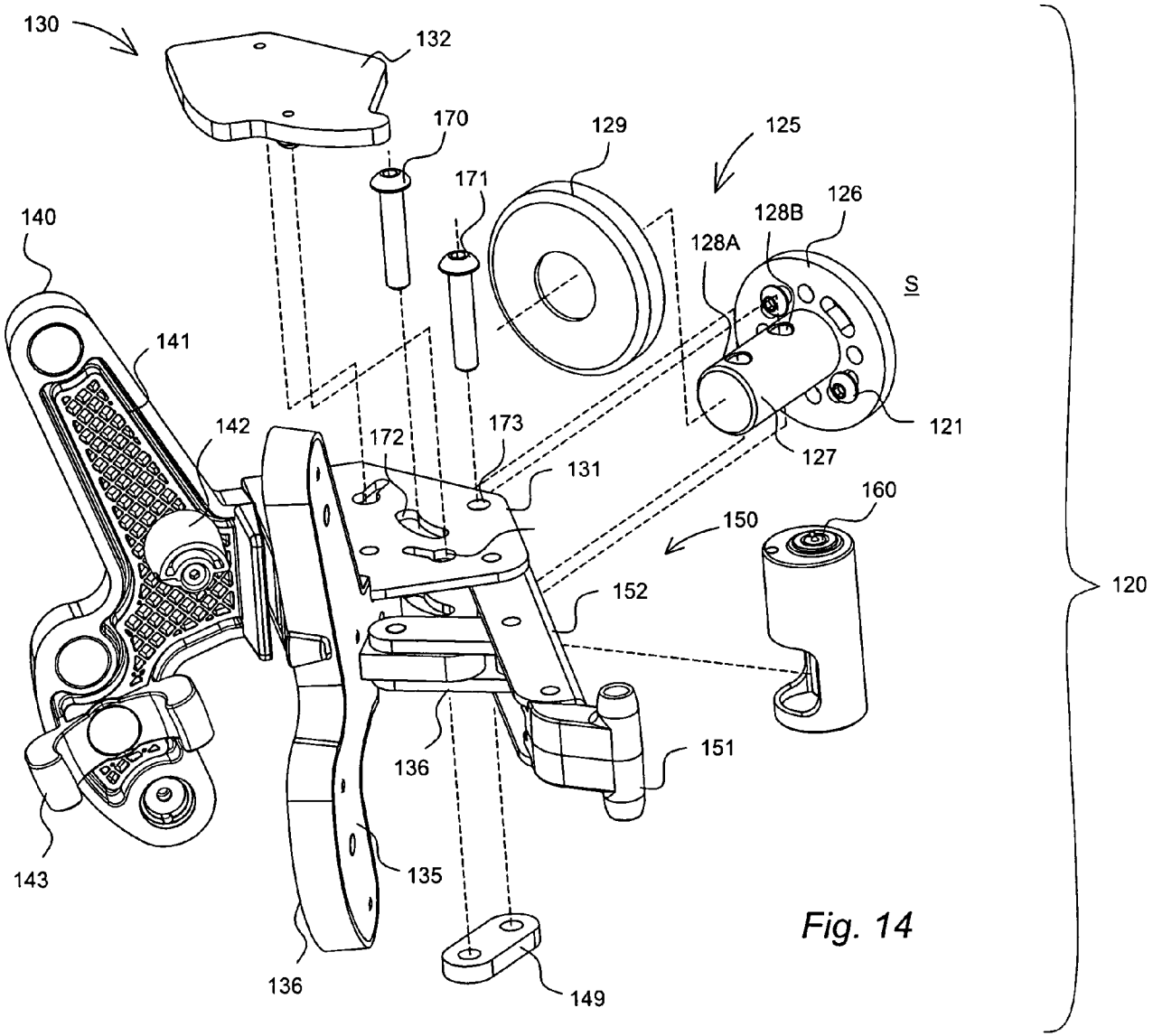
FIG. 14 is a representative exploded view of a firearm security device according to one preferred embodiment of the present invention.

FIG. 14 is a partially exploded view of firearm security device 120. Firearm security device 120 includes movable plate 135 and fixed plate 140 connected to frame member 131 of frame assembly 130. Second grip pad 136 is attached to movable plate 135 and first grip pad 141 is attached to fixed plate 140. Fixed plate 140 includes trigger guard stud 142 and rifle/shotgun adapter 143. Frame assembly 130 is pivotably connected to base assembly 125. Spindle 127 extends from base portion 126 which is in turn attached to surface S. Base security cover 129 is placed over spindle 127 covering base portion 126 and screws 121. A pair of screws 170 and 171, project through slotted aperture 172 and pivot aperture 173 of frame member 131 and a pair of apertures 128A and 128B of spindle 127, connecting to backing strip 149. When installing, the angle between frame member 131 and spindle 127 is adjusted to a desired angle and screw 170 is tightened fixing the angle. Frame security cover plate 132 attaches to frame member 131 covering and securing screws 170 and 171 from removal. Movable plate 135 is shifted with respect to fixed plate 140 by operation of clamping assembly 150. Pull 151 of lever 152 is pulled and lever 152, which is pivotably attached to frame member 131, and movable plate 135, attached to lever 152 by linkage 155, pivots to an opened position as shown in FIG. 14 Lock assembly 160 is mountable to lever 152.

Figure 16:
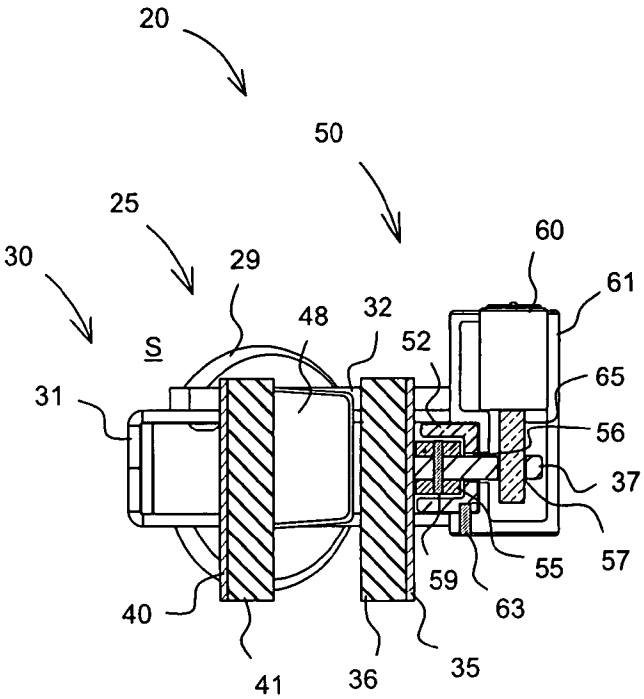
FIG. 16 is a representative front cutaway view of a firearm security device according to one preferred embodiment of the present invention.
Figure 15:
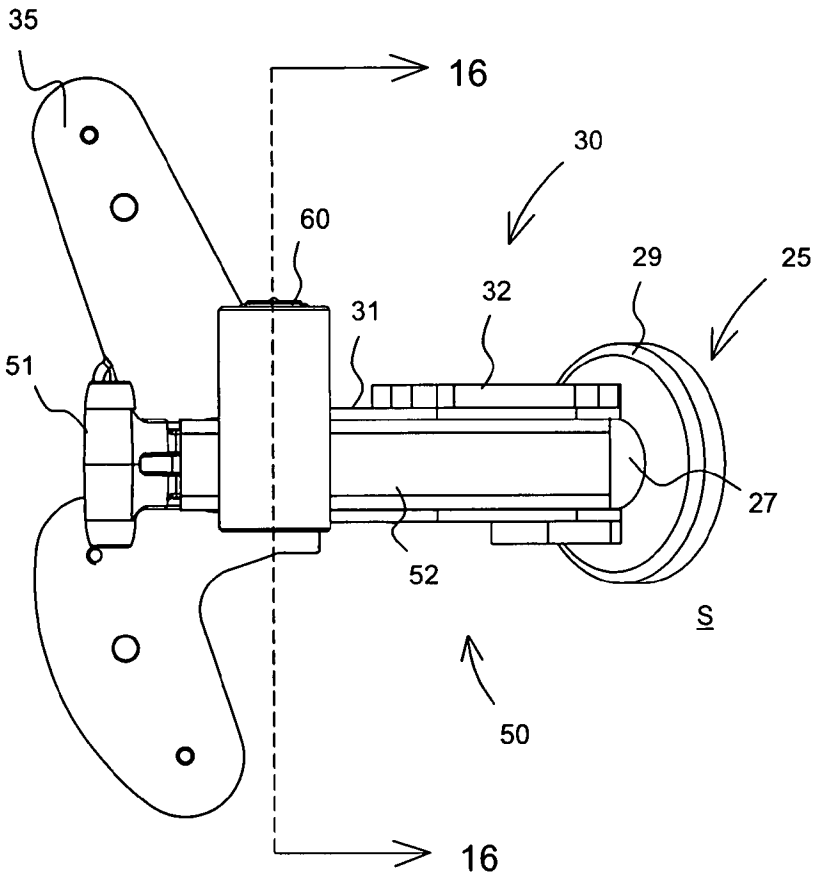
FIG. 15 is a representative side view of a firearm security device according to one preferred embodiment of the present invention.

FIG. 15 is a side view of firearm security device 20. FIG. 16 is a partial cutaway view of firearm security device 20. FIGS. 15 and 16 show the relationship between lock 60 and firearm security device 20. Firearm security device 20 includes frame assembly 30 having frame member 31 which is connected to spindle 27, shown in FIG. 15, of base assembly 25. Base assembly 25 mounts to surface S. Base security cover 29 is placed over spindle 27. Frame security cover plate 32 attaches to frame member 31. Movable plate 35, including second grip pad 36, as seen in FIG. 16, and fixed plate 40 including first grip pad 41 are also connected to frame member 31. Movable plate 35 may be shifted by operation of clamping assembly 50. Clamping assembly 50 includes pull 51, shown in FIG. 15, connected to lever 52. Bumper 48 can be seen in FIG. 16 extending from first grip pad 41 between fixed plate 40 and movable plate 35.

Lock 60 is attached to lever 52. More particularly and referring to FIG. 16, lock 60 includes lock housing 61 that is held in position with respect to lever 52 by set screw 63. Lever 52 is pivotably attached to movable plate 35 by means of linkage 55. Linkage 55 is pivotably attached to tab 37 by pin 59. Aperture 57 located at a distal end of tab 37 is adapted to project through slot 56 located in lever 52 and is engageable by bolt 65 of lock 60 to control access to a stored firearm.

The foregoing description of the illustrated embodiments has been presented for purposes of illustration and description. It is not intended to be exhaustive or to limit the invention to the precise form or to exemplary embodiment(s) and implementation(s) disclosed. Numerous modifications and variations will be apparent to practitioners skilled in this art. Elements described might be interchangeable with other elements in order to achieve the same result. At least one preferred embodiment was chosen and described in order to best explain the principles of the invention and a best mode of practical application, thereby to enable others skilled in the art to understand the invention for various embodiments and with various modifications as are suited to the particular use or implementation contemplated. It is intended that the scope of the invention be defined by the claims appended hereto and their equivalents. Reference to an element in the singular is not intended to mean "one and only one" unless explicitly so stated, but rather means "one or more." Moreover, no element, component, nor method step in the present disclosure is intended to be dedicated to the public regardless of whether the element, component, or method step is explicitly recited in the following claims. No claim element herein is to be construed under the provisions of 35 U.S.C. Sec. 112, sixth paragraph unless the element is expressly recited using the phrase "means for . . . "

What is claimed is:

1. A firearm security device attachable to a surface for securing a firearm including a trigger guard, a receiver and a grip, the firearm security device comprising:

a frame pivotably connected to a base assembly, the base assembly attachable to the surface;

a first plate including a first grip pad, the first plate fixed to the frame;

a trigger guard stud attached to the first plate, the trigger guard stud projecting from an inner surface of the first grip pad, the trigger guard stud adapted for insertion through the trigger guard of the firearm;

a firearm support member projecting from the first grip pad, the firearm support member adapted for positioning below the receiver of the firearm;

a second plate including a second grip pad, the second plate pivotably connected to the frame; and a clamping assembly including a lever pivotably connected between the frame and the second plate, the second plate pivotable by operation of the lever from an open position wherein the firearm is positionable against the inner face of the first plate with the trigger guard stud projecting through the trigger guard of the firearm, to a closed position wherein the second plate is pivoted to a position substantially parallel to and opposing the first plate, at least a portion of the receiver of the firearm held in a compressive grip between the first plate and the second plate, the second plate held in a closed position by an over-center clamping action of the clamping assembly.

2. The firearm security device of claim 1 further comprising a lock adapted to selectively restrict movement of the second plate relative to the opposing first plate.

* * * * *